US007415124B2

(12) United States Patent
Colich

(10) Patent No.: US 7,415,124 B2
(45) Date of Patent: Aug. 19, 2008

(54) LOW FREQUENCY SURFACE ARRAY

(75) Inventor: Dragoslav Colich, Costa Mesa, CA (US)

(73) Assignee: HPV Technologies LLC, Costa Mesa, CA (US)

( * ) Notice: Subject to any disclaimer, the term of this patent is extended or adjusted under 35 U.S.C. 154(b) by 777 days.

(21) Appl. No.: 11/077,578

(22) Filed: Mar. 11, 2005

(65) Prior Publication Data

US 2005/0201583 A1 Sep. 15, 2005

Related U.S. Application Data

(60) Provisional application No. 60/553,499, filed on Mar. 15, 2004.

(51) Int. Cl.
*H04R 25/00* (2006.01)

(52) U.S. Cl. ..... 381/335; 381/182; 381/87; 381/386; 181/199

(58) Field of Classification Search ..... 381/332, 381/335, 336, 87, 386, 182; 181/145, 148, 181/152, 199
See application file for complete search history.

(56) References Cited

U.S. PATENT DOCUMENTS 2,632,055 A * 3/1953 Parker ..... 381/335
5,000,286 A * 3/1991 Crawford et al. ..... 181/145
5,590,214 A * 12/1996 Nakamura ..... 381/182
5,602,366 A * 2/1997 Whelan et al. ..... 181/144
6,394,223 B1 5/2002 Lehman

OTHER PUBLICATIONS

Weems, David B., *Designing, Building, and Testing Your Own Speaker System*, 4th Edition, New York: McGraw-Hill, 1997.
Weems, David B., et al., *Great Sound Stereo Speaker Manual*, Second Edition, New York: McGraw-Hill, 2000.

* cited by examiner

*Primary Examiner*—Suhan Ni
*Assistant Examiner*—Jasmine Pritchard
(74) *Attorney, Agent, or Firm*—Fish & Associates, PC

(57) ABSTRACT

A low-frequency loudspeaker system based on a dipole principle. In some implementations, the system includes an open frame rigging system and multiple subwoofers mounted in a dipole surface array configuration in the open frame rigging system to produce controlled sound dispersion in both horizontal and vertical planes. The subwoofers are operable to produce low-frequency sound dispersion below about 300 Hz. The subwoofers mounted in the dipole configuration include a first set of subwoofers facing a first direction and a second set of subwoofers facing a second direction, in which the second direction is facing a direction that is 180 degrees with respect to the first direction. The second set of subwoofers are wired out-of-phase with respect to the first set of subwoofers to reduce non-liner distortion. The first and second sets of subwoofers are configured to concurrently move in a same direction when a signal is applied to the subwoofers.

24 Claims, 13 Drawing Sheets

FIG. 15B
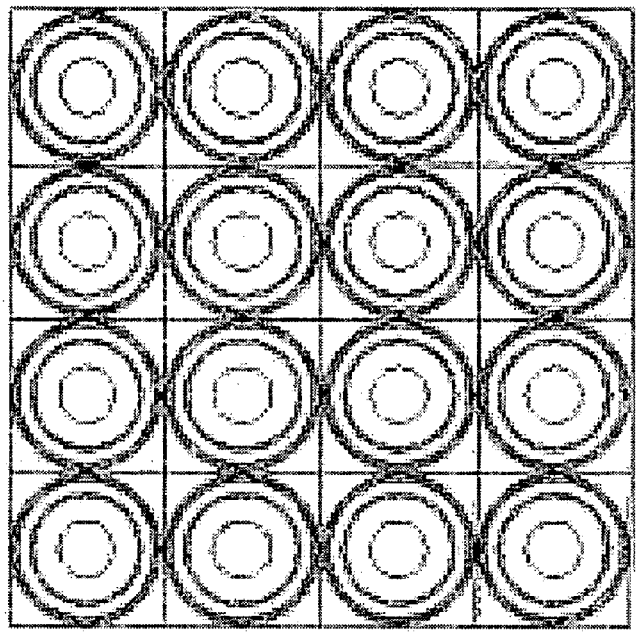
FIG. 15C
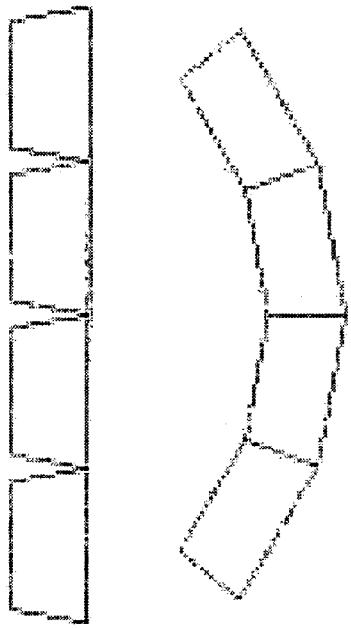
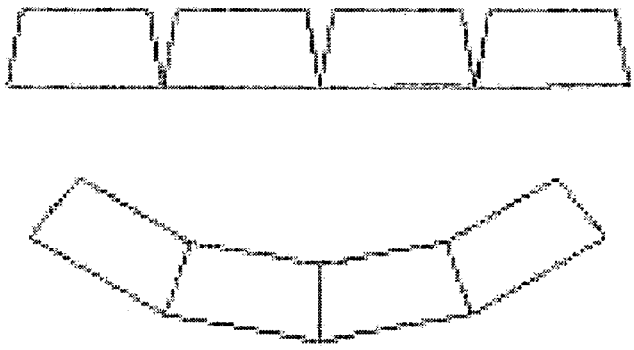
FIG. 15A

LOW FREQUENCY SURFACE ARRAY

CROSS REFERENCE TO RELATED APPLICATIONS

This application claims the benefit of priority from U.S. Provisional Application entitled "Low Frequency Surface Array", Application No. 60/553/499 filed Mar. 15, 2004 by Dragoslav Colich, the disclosure of which is incorporated by reference.

TECHNICAL FIELD

The present disclosure relates to speakers, in particular low-frequency loudspeakers.

BACKGROUND

Traditional sound reinforcement loudspeaker systems may use "Line Arrays" and additional subwoofers to achieve a desired sound coverage and sound pressure level (SPL). In line arrays, low-frequency energy may be adequately controlled by adjusting the size of the array and by vertical splaying or vertically spreading the line array cabinets. If a very low frequency range is desired, additional subwoofer cabinets can be used, which are typically stacked on the ground. Subwoofer vertical sound dispersion can be attempted to be controlled by building stacks of cabinets of adequate height.

SUMMARY

The present disclosure describes methods, techniques, and systems relating to loudspeakers. In one aspect, devices and methods for are disclosed producing a low-frequency loudspeaker surface array based on a dipole principle that uses flat panel or conical low-frequency transducers. The flat panel or cone low-frequency transducers are mounted on a flat or curved surface to produce controlled low-frequency sound dispersion in both the horizontal and vertical planes. The apparatus described here may use a dipole subwoofer surface array with common line arrays or planar magnetic surface arrays to extend useful frequency ranges below 300 Hertz (Hz).

In one general aspect, a dipole speaker system includes an open frame rigging system and multiple subwoofers mounted in a dipole configuration in the open frame rigging system to produce controlled sound dispersion in horizontal and vertical planes. The subwoofers are operable to produce low-frequency sound dispersion below about 300 Hz. The subwoofers mounted in the dipole configuration include a first set of subwoofers facing a first direction and a second set of subwoofers facing a second direction, in which the second direction is substantially 180 degrees with respect to the first direction. The first and second sets of subwoofers are configured to concurrently move in a same direction when a signal is applied to the subwoofers.

Advantageous implementations can include one or more of the following features. The dipole speaker system may be a modular system of open frames. The dipole speaker system may be a hanging system or supported on a flat surface.

In operation, approximately half of an amount of coils in each subwoofer may be configured to travel inside a magnetic gap of the subwoofer, and approximately half of the amount of coils in each subwoofer may be configured to travel outside the magnetic gap. The speaker system may be configured to cancel non-linear distortion, and the subwoofers can be closely spaced in the rigging system to create a large baffle.

At least two or more subwoofers may be connected in the rigging system in a first row in the first direction, and at least two or more subwoofers may be connected in the rigging system in a second row in the second direction. The rigging system may include multiple pairs of rows of subwoofers, in which a first row in a row pair may be facing the first direction and a second row in the row pair may be facing the second direction, and the rigging system may be configurable to be adjusted so that adjacent row pairs face different angles. The dipole speaker system may be adjustable such that the multiple pairs of rows of subwoofers form a curved surface when a size of the dipole speaker system is about a comparable size as an acoustic wavelength produced at a predetermined frequency. The subwoofers may include drivers, and the drivers of the second set of subwoofers may be electrically wired out-of-phase (e.g., a polarity that is a reverse polarity of the first set of subwoofers) to reduce non-linear distortion.

In another general aspect, a loudspeaker surface array includes one or more rows of dipole speakers, in which each dipole speaker includes a first speaker facing a first direction and a second speaker facing a second direction. The second direction is facing a direction that is 180 degrees from the first direction. The second speaker is electrically wired out-of-phase with respect to the first speaker to reduce non-liner distortion. Each of the first and second speakers is configured to concurrently move in a same direction when a signal is applied. The loudspeaker surface array includes an open frame rigging system to mount each dipole speaker in the one or more rows.

Advantageous implementations can include one or more of the following features. The open frame rigging system may have flexible joints so that at least two or more rows of dipole speakers form a curved dipole surface array. The flexible joints may be configured to enable two or more rows of dipole speakers to be splayed to effectively direct sound coverage across a range of angles. The rigging system may be configured to enable the loudspeaker surface array to be suspended at a pre-determined elevation above ground. The speakers may include any of sound reinforcement subwoofers, flat panel transducers, cone transducers, and long-throw, low-distortion, fast woofers.

The rigging system may be configured to enable the loudspeaker surface array to direct sound at different angles along a curved surface when a size of the loudspeaker surface array is similar to a size of a wavelength of a sound produced at a predetermined frequency. The size (horizontal and/or vertical size) of the loudspeaker surface array may be a fraction of the size of a wavelength of the sound produced or may be a multiple of the size of a wavelength of the sound produced.

In another general aspect, a method to produce controlled low-frequency sound dispersion in both horizontal and vertical planes of a dipole loudspeaker surface array involves mounting a first row of subwoofers in a first direction in an open frame rigging system, and mounting a second row of subwoofers in a second direction in the open frame rigging system, in which the second direction is about 180 degrees with respect to the first direction. The method involves wiring the subwoofers in the second row to be out-of-phase with respect to the subwoofers of the first row to reduce non-liner distortion. The first and second rows of subwoofers are configured to concurrently move in a same direction when a signal is applied. Each subwoofer is operable to produce low-frequency sound dispersion below about 300 Hertz.

Advantageous implementations can include one or more of the following features. Each row may have closely-spaced subwoofers. The method may include mounting a third row of subwoofers in the first direction in an open frame rigging system, mounting a fourth row of subwoofers in the second direction in the open frame rigging system, and wiring the subwoofers in the fourth row to be out-of-phase with respect to the subwoofers in the third row to reduce non-liner distortion. The subwoofers of the third and fourth rows may be configured to concurrently move in a same direction when a signal is applied.

The method may involve adjusting the direction of the rows of the dipole loudspeaker surface array to change a horizontal and/or a vertical acoustical radiation pattern. Additional rows of subwoofers in a dipole configuration may be added to narrow a sound dispersion pattern for a frequency. The method may include controlling a directionality of sound dispersion by adding additional rows of subwoofers in a dipole configuration, in which a size of the dipole loudspeaker surface array is comparable to a size of a wavelength of a predetermined frequency produced by the array. The directionality of sound dispersion may also be controlled by adjusting a curvature of the dipole loudspeaker surface array when the size of the array is comparable to a size of the wavelength of the predetermined frequency produced by the array.

The techniques and systems described here may offer several advantages. In one implementation, a system includes multiple low-frequency drivers arranged on a flat or curved surface to create adequate acoustical output and to provide a desired sound coverage without using heavy, bulky closed cabinets. A modular system of open frames that are connected with a rigging system may enable an array of drivers to be hung in the air or positioned on the ground or another flat, stable surface.

In one example, four 12" long-throw, low-distortion, fast subwoofers are mounted in each frame. "Long-throw" subwoofers may refer to the excursion of the diaphragm or cone. The "excursion" may refer to an amplitude of the movement of the cone from front to back when the cone is producing sound. "Low-distortion" may refer to a low total harmonic distortion (THD) for a given power supplied to the subwoofer at a given frequency and cone excursion. Frames can be of shallow construction. "Shallow" construction may refer to having a frame that has a depth that is around the same depth of the cone or drivers. For example, a frame implemented in the dipole surface array may have depth of 7", while a driver in a conventional speaker box may require a depth of 20"-30" for the speaker box. The rigging system is part of the speaker system and may refer to how the dipole surface array is constructed. The dipole surface array may not have the acoustic-limiting issues associated with closed cabinets or closed boxes because the dipole surface array does not use closed cabinets. In some implementations, for example, the dipole system can be 6 dB more efficient than a closed cabinet with similar dimensions.

In other implementations, dipole speakers can be used in a sound reinforcement subwoofer application to provide high-quality low-frequency extension with controlled directionality. When the size of the dipole surface array is comparable to the size of the acoustic wavelength produced by the array, there may be increased control of the directionality of sound dispersion for low frequencies. The dipole surface array can have increased directionality for sound patterns along curved surface arrays when the size of the dipole array is similar to the acoustic wavelength produced. Other potential advantages may include easy control of sound dispersion patterns at low frequencies, and high-quality sound reproduction. Because closed boxes are not used in the disclosed implementations, no cabinet resonance and sound coloration results. Some implementations may have maximum acoustical output that is comparable to conventional dual 18" subwoofer designs. The dipole surface array implementations can be modular, compact, lightweight, and easier to handle than conventional closed-cabinet designs. In some implementations, half of the cone's coils travel inside of the magnetic gap and half travel outside of the magnetic gap, which can effectively cancel non-linear distortion and allow cleaner sound at maximum sound pressure levels when compared to conventional designs.

Details of one or more implementations are set forth in the accompanying drawings and the description below. Other features and advantages will be apparent from the description and drawings, and from the claims.

DRAWING DESCRIPTIONS

FIG. 15A shows a side view of a vertically curved surface array.

FIG. 15B shows a flat surface array of the subwoofer array of FIG. 15A.

FIG. 15C shows a side view of a horizontally curved surface array of the flat surface array of FIG. 15B.

Like reference symbols in the various drawings indicate like elements.

DETAILED DESCRIPTION

For convenience in the ensuing description, some explanations of terms are provided herein. However, the explanations contained herein are intended to be exemplary only. They are not intended to limit the terms as they are described or referred to throughout the specification. Rather these explanations are meant to include any additional aspects and/or examples of the terms as described and claimed herein and/or as used by one of skill in the art.

The following describes various tasks, techniques, and systems relating to loudspeaker design and performance. Traditionally, subwoofer vertical sound dispersion has been attempted to be controlled by building heavy, space-consuming stacks of cabinets of adequate height. Traditional subwoofer cabinets can be very bulky and heavy, and may require many people to transport and position the cabinets.

Figure 1:
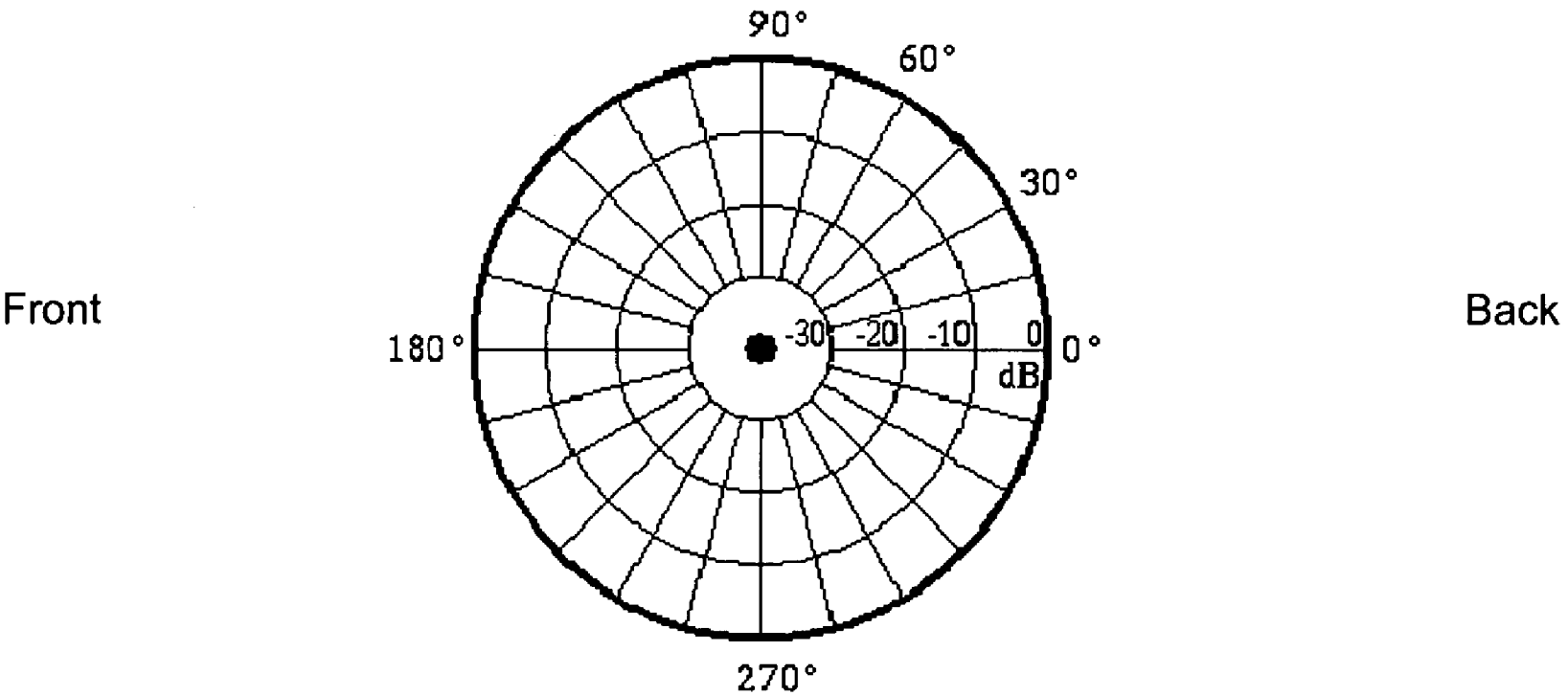
FIG. 1 shows an omni-directional sound dispersion pattern.

Typical low-frequency loudspeakers may use a variety of cabinets to isolate front sound radiation from the back sound radiation of the driver to prevent acoustical cancellation of those two out-of-phase wave fronts. There are several types of cabinets or enclosures used in subwoofer systems, including sealed, vented, band pass, and transmission line. All of these types of subwoofer systems tend to have an omni-directional radiation pattern below 200 Hertz. FIG. 1 shows an omni-directional sound dispersion pattern. The disclosed design does not use conventional subwoofer cabinets and can thus avoid some of the issues associated with conventional subwoofer cabinets. In conventional subwoofer cabinets, internal air volume resonance, cabinet sides resonance, and air compression of the port in vented or band-pass cabinets can result in high distortion, coloring and reduced sound quality. Vented boxes are also called reflex or ported boxes, in which these enclosures have some type of vent, such as a hole or tube, that can tune the box to a preselected frequency. Sound reinforcement subwoofers are usually designed around 18" subwoofers in an effort to achieve additional output. These large subwoofer cones may be typically crossed over with line arrays below 100 Hertz. The large subwoofer cones may also have high mass and high inertia, which may restrict their useful high frequency range.

A common type of conventional subwoofer design is a vented cabinet, sometimes called a "bass reflex" design. The cabinet and port in a base reflex design can be typically designed around specific subwoofer acoustical and electrical parameters to target a specific frequency response. The cabinet size and port can work in conjunction to produce secondary port resonance, which effectively extends low-frequency response. Using the loudspeaker with a vented cabinet can produce more output with less excursion compared to a sealed box or sealed cabinet. Over time, subwoofer parameters may change, which may contribute to mistuning of the bass reflex design and deterioration of the overall sound performance.

As the power increases in the conventional subwoofer design, more air is required to go through the port. The amount of air that goes through the port can be restricted by the size of the port and the size of the cabinet. As a result, the amount of air flow does not follow a commensurate power increase. This result is known as "port compression", a phenomenon in which the frequency response changes with the power with less low-frequency extension as the power increases. The output from the port can be limited despite having ample power provided to the subwoofer. Sophisticated dynamic equalization can provide a limited solution.

Regarding horizontal sound dispersion, subwoofers, which typically use a closed-cabinet arrangement, exhibit omni-directional dispersion characteristics below 200 Hertz. As a result, unintended low-frequency feedback can be heard on the stage and in the audience. Another result of using traditional closed-cabinet arrangements may be the reduction of gain before total system feedback occurs, which can minimize the total dynamic range of reproduced live sound.

18" subwoofers may not be practical or functional to extend low-frequency range of planar magnetic arrays. The transient response of planar magnetic transducers can be superior to the transient response of conventional heavy cone drivers. As a result, blending the two frequency ranges and have them sound as if they are from one source may be difficult to achieve.

Figure 2:
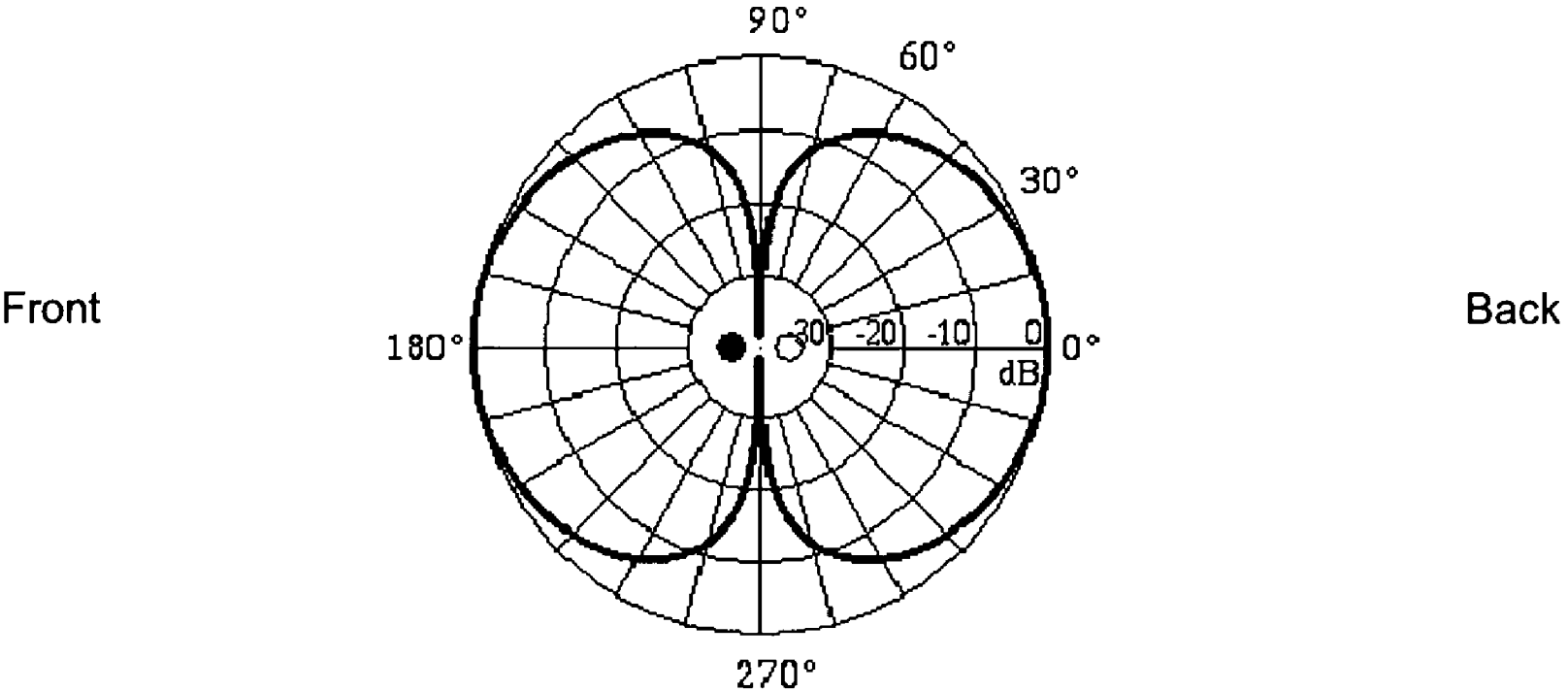
FIG. 2 shows a dipole acoustic radiation pattern.

Dipole low-frequency speakers can have many benefits. For example, dipole speakers do not radiate sound on the sides. If a dipole array is suspended at an adequate elevation, the array will not radiate sound on the top or the bottom. A "dipole" has a horizontal sound radiating pattern similar to the pattern shown in FIG. 2, and the same sound radiating pattern for a vertical plane. Thus, a dipole array can be directional at all frequencies. Conventional dual subwoofer designs may not be dipole configurations, but may be bipolar configurations. The dipole design described herein is wired such that each dipole pair of speakers is acoustically in phase and can cancel non-linear distortion to produce a clean sound.

The dipole subwoofer array can have an acoustical pattern directed to the back and the front of the array. Such a configuration may be useful when positioning the array beside a sound stage. For example, an artist may be performing on a sound stage and the dipole array can direct sound to the front and back of the array towards an audience, but may not direct sound to the sides of the array where the artist may be performing. A conventional closed-box design may have an omni-directional acoustical pattern, in which the loud sounds produced by the speakers can interfere with the artist performing on the stage.

Dipole speakers may have acoustical cancellation of the front and back sound waves. To obtain good low-frequency extension, very large baffles can be used to isolate the front and the back of the speaker. In some aspects, the current disclosure describes using dipole speakers in a sound reinforcement subwoofer application.

Figure 3:
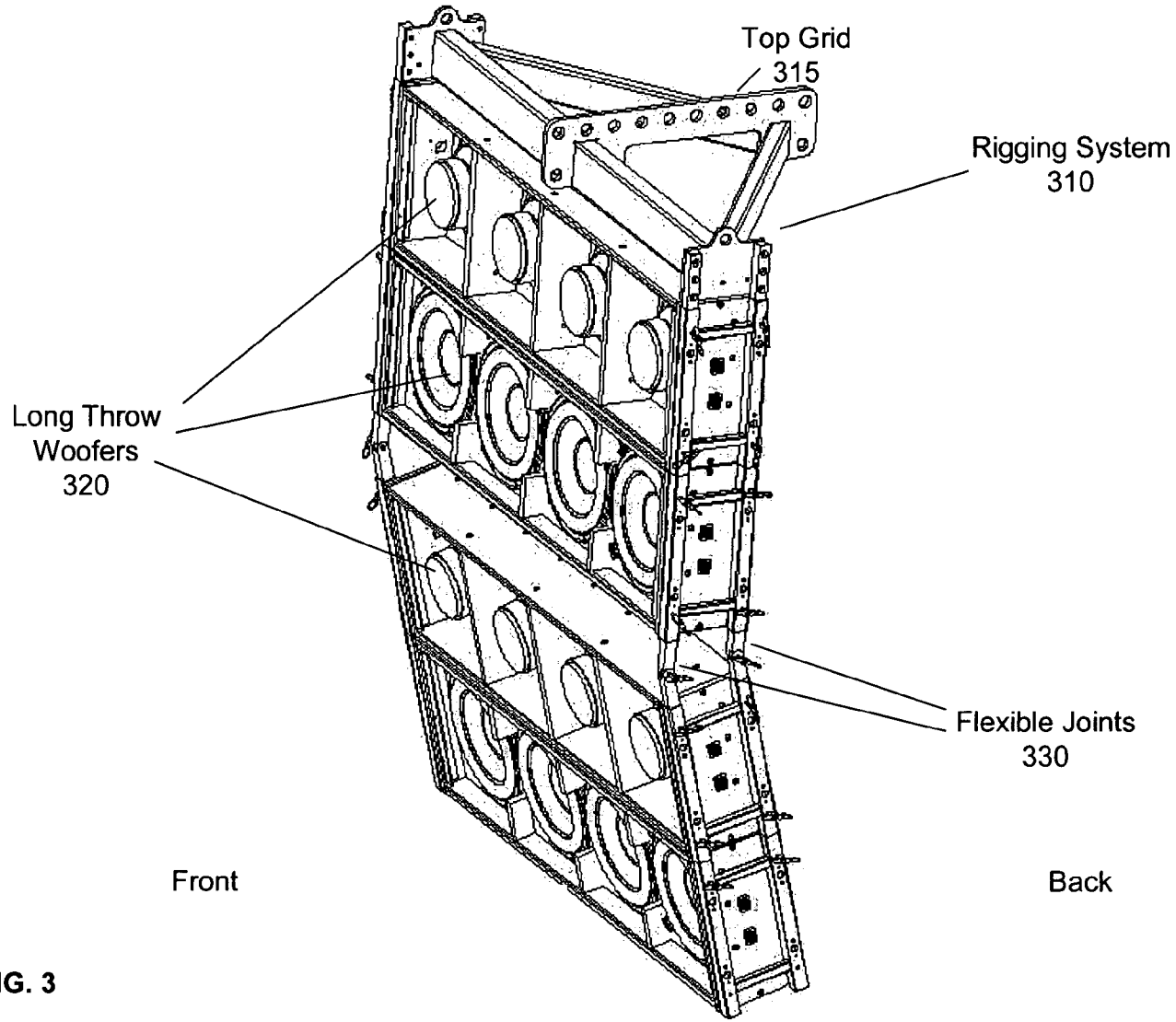
FIG. 3 shows a low-frequency dipole surface array with four rows and a top grid.

The implementation in FIG. 3 shows four frames (or rows), in which each frame (or row) includes four mounted subwoofers. A dipole surface array 310 holds the four frames together. The first row has four open-back subwoofers facing a back side (to the right in FIG. 3). The second row comprises four open-back subwoofers facing a front side (to the left in FIG. 3). A "dipole" configuration may be as simple as two subwoofers, one facing a back side and one facing a front side. The rigging has flexible joints 330 that allow the subwoofers to be mounted to form a flat surface or a curved surface. The subwoofers shown in FIG. 3 are long throw subwoofers 320. In an alternative configuration, subwoofers could be oriented all to one side with slightly higher total harmonic distortion (THD).

The dipole surface array can be curved at different angles to increase the directionality of the sound patterns. FIG. 3 shows that the dipole surface array is curved approximately 15 degrees. Typically, the directionality of higher frequency (greater than 300 Hz) speaker systems may be easier to control than low-frequency speaker systems. Low-frequency systems can produce longer wavelengths than higher frequency systems and low-frequency systems can be more difficult to direct the sound dispersion. The size (e.g., horizontal and/or vertical size) of the low-frequency dipole surface array can be a factor in controlling the directionality of the sound patterns for low frequencies at 300 Hz and below. In some exemplary implementations, the directionality of the sound produced can be increased by using a dipole surface array that is similar in size to the acoustic wavelengths produced. For example, for dipole surface arrays producing sound at frequencies between 30 Hz-300 Hz, the size of the curved dipole arrays can range from approximately 10 meters at 30 Hz to approximately 1 meter at 300 Hz. The size low-frequency dipole surface array may also be a size that is a fraction of a wavelength or a multiple of a wavelength for the given frequency. For example, the size of the dipole surface array may be one half of the distance a wavelength at 100 Hz (1.5 meters in size).

The dipole surface array can be made larger with additional rows in the vertical and/or horizontal planes. As the dipole surface array is made larger in the vertical and/or horizontal planes, the dipole surface array may be curved at different or increased angles in the vertical and/or horizontal planes to direct acoustic wave patterns in those directions. Additional rows may be stacked onto the dipole surface array to vary the acoustical patterns in those directions. For example, a low-frequency dipole surface array with 6-12 vertical rows of speakers may have an increase curved surface to direct acoustical patterns along a vertical direction. Alternatively, a low-frequency dipole surface array with 6-12 horizontal rows may have an increased curved surface to direct acoustical patterns along a horizontal direction. In some implementations, the low-frequency dipole surface array may 6-12 additional rows in both the horizontal and vertical directions to have increased curved surfaces to direct acoustical patterns along both the horizontal direction and the vertical direction at low frequencies. The number of rows of speakers are not limited to the numbers described or shown, but may vary.

A dipole low-frequency surface array can radiate less energy on the sides of the array, and on the top and bottom of the array than conventional subwoofer cabinets. With proper positioning around a sound stage, for example, the dipole array could achieve up to 9 dB less energy on the stage than by using a comparable number of conventional subwoofer cabinets.

Very long throw cone subwoofers or flat panel transducers may be used for a dipole subwoofer array to create enough output at low frequencies to compensate for the loss of output due to acoustical cancellation. As shown in FIG. 3, a number of low-frequency drivers are arranged on a flat or curved surface to create adequate acoustical output and to provide a desired sound coverage. The drivers can be closely spaced on a flat or curved surface to effectively create a large baffle allowing the dipole array to function with low frequencies without losing output. The size of the structure can determine the dispersion angle and low-frequency extension. If more output is desired at lower frequencies, then a larger structure and more drivers may be used. Vertical and/or horizontal dispersion can depend on the number of rows used. If the dispersion pattern becomes too narrow, the drivers could be arranged on a curved surface. If the coverage becomes too narrow, the dipole surface array can allow rows to be splayed to effectively increase the coverage to a desired angle.

The configuration shown in FIG. 3 represents a modular system of open frames that are connected with a dipole surface array 310, which can allow the array to be hung in the air or positioned on the ground or another flat, stable surface. Four 12" long throw, low-distortion, fast subwoofers 320 are mounted in each frame. Frames are of shallow construction. The dipole surface array tends to minimize the acoustic-limiting issues associated with closed cabinets because the dipole surface array does not use closed cabinets.

In one exemplary configuration, acoustical cancellation starts around 100 Hz and frequency response gently drops below that frequency with a slope of 6 dB per octave. Effectively, the dipole cabinet can be 6 dB more efficient than a closed box with similar dimensions. In some implementations, the efficiency and maximum output of one dipole subwoofer row is comparable to the output of a typical dual 18" subwoofer cabinet above 70 Hz. If more output is needed below 70 Hz, then more rows can be used.

Half of the used drivers are oriented backwards and electrically wired out of phase to reduce non-linear distortion due to high cone excursion. For example, a subwoofer facing a forward direction may have an electrical connection such that the positive terminal of the subwoofer is connected to the positive wire of the speaker system and the negative terminal of the subwoofer is connected to the negative wire of the speaker system. The subwoofer facing the backwards direction may have an electrical connection such that the positive terminal of the subwoofer is connected to the negative wire of the speaker system and the negative terminal of the subwoofer is connected to the positive wire of the speaker system. When the front and back dipole subwoofers are in use, the front and back subwoofers are wired out of phase (e.g., opposite polarity) and the drivers of the front and back subwoofers can move in the same direction at the same time (i.e., the front subwoofer and the back subwoofer may both move to the forward direction at the same time or the backward direction at the same time).

The magnetic fields of the magnets of the subwoofers are typically non-linear magnetic fields, and a subwoofer may have better acoustic performance when the cone's coils travel in a given direction (e.g., inside the magnetic field) in the magnetic field than when the cone is moving in the opposite direction (e.g., outside the magnetic field). By using a dipole subwoofer in which one of the subwoofers in the dipole pair will have a better acoustic performance than the other subwoofer, the acoustic output and performance may be cleaner than when the dipole subwoofer cones are not concurrently traveling in the same direction (e.g., traveling forwards or backwards). In some implementations, half of the cone's coils travel inside of the magnetic gap and half outside, which effectively cancels non-linear distortion and allows cleaner sound at maximum sound pressure levels. The magnetic field in the subwoofer motor does not have to be perfectly symmetrical, and neither does the suspension of the cone. In some implementations, there can be 90 degrees of horizontal dispersion at 100 Hz.

Figure 4:
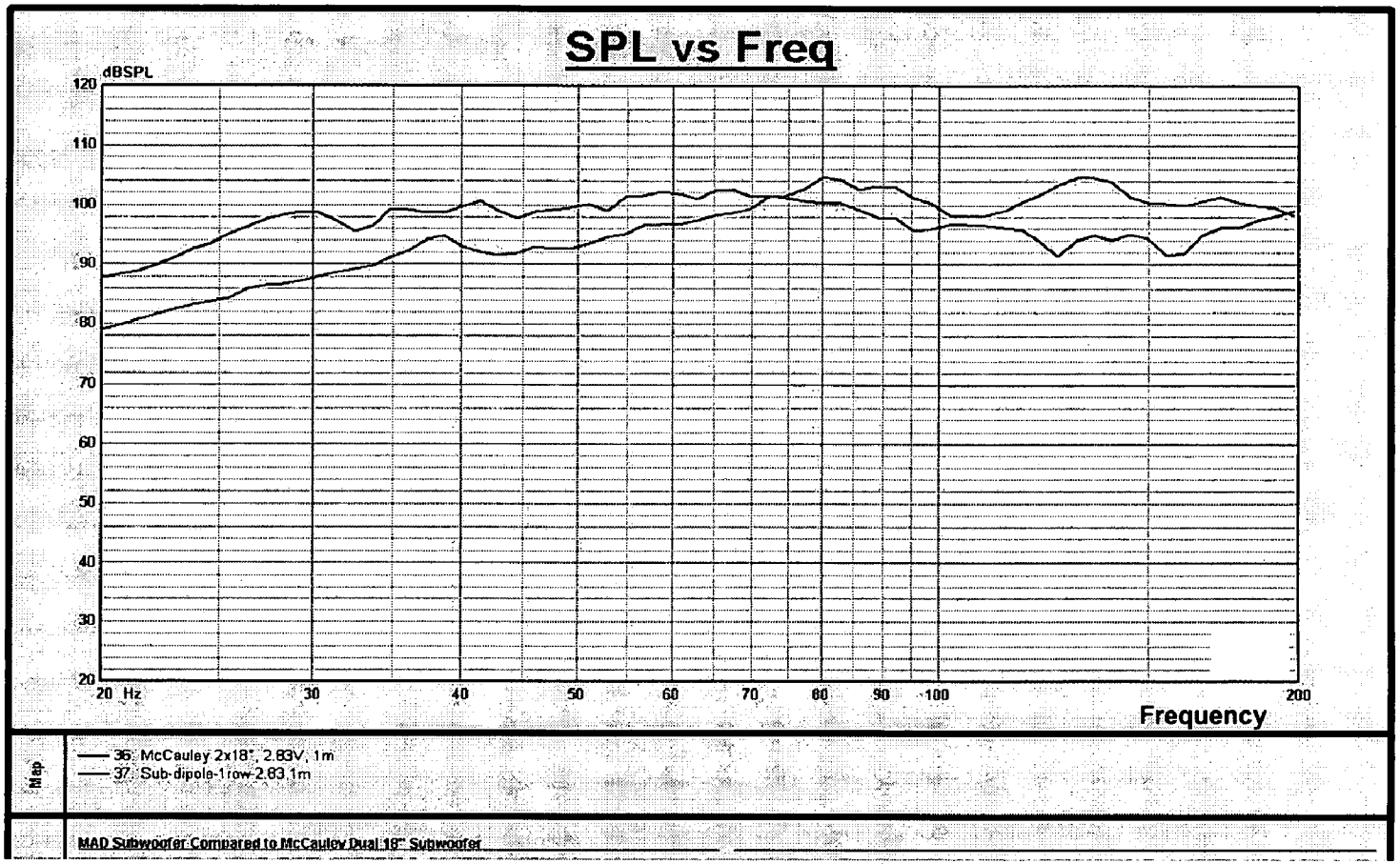
FIG. 4 shows an exemplary graph of sound pressure level (SPL) versus frequency for two different types of subwoofers.

FIG. 4 shows an exemplary graph of sound pressure level (SPL) vs. frequency for two different types of subwoofers. In particular, FIG. 4 shows a measured SPL of a conventional dual 18" vented subwoofer cabinet and a measured SPL of one row of an exemplary implementation of a dipole subwoofer array that includes four 12" long throw subwoofers. The driving voltage for both types of speakers system is 2.83V RMS (root mean square) and the measured distance is 1 meter on axis.

The gentle roll off shown for the SPL for the dipole speaker below 70 Hz may be due to acoustical cancellation. Above 70 Hz, the exemplary dipole speaker array can be more efficient than the conventional vented subwoofer cabinet. The dipole speaker array and the vented subwoofer cabinet may have similar power handling and maximum cone excursion, as well as comparable maximum output. FIG. 4 shows that the exemplary dipole speaker array can be much more suitable to cross over at higher frequencies with more acoustical energy provided above 70 Hz. With additional rows connected together in the dipole subwoofer array, effective baffle size created by the joined rows may increase, and acoustical cancellation can occur at a lower frequency. In some exemplary implementations, dipole surface arrays may complement a flat panel surface array and provide high quality low-frequency extension with controlled directionality.

Figure 5:
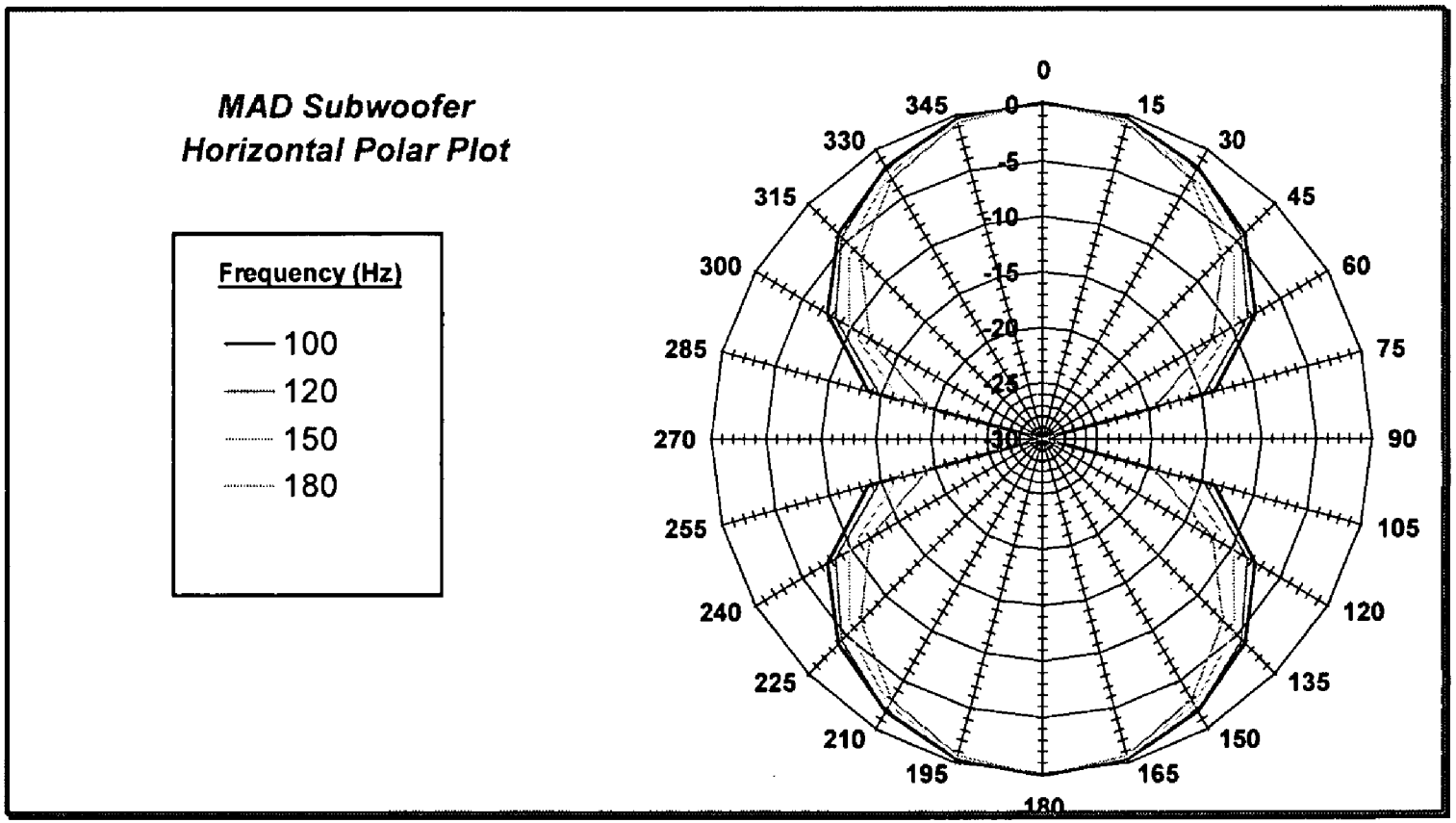
FIG. 5 shows simulated horizontal polar plots.
Figure 6:
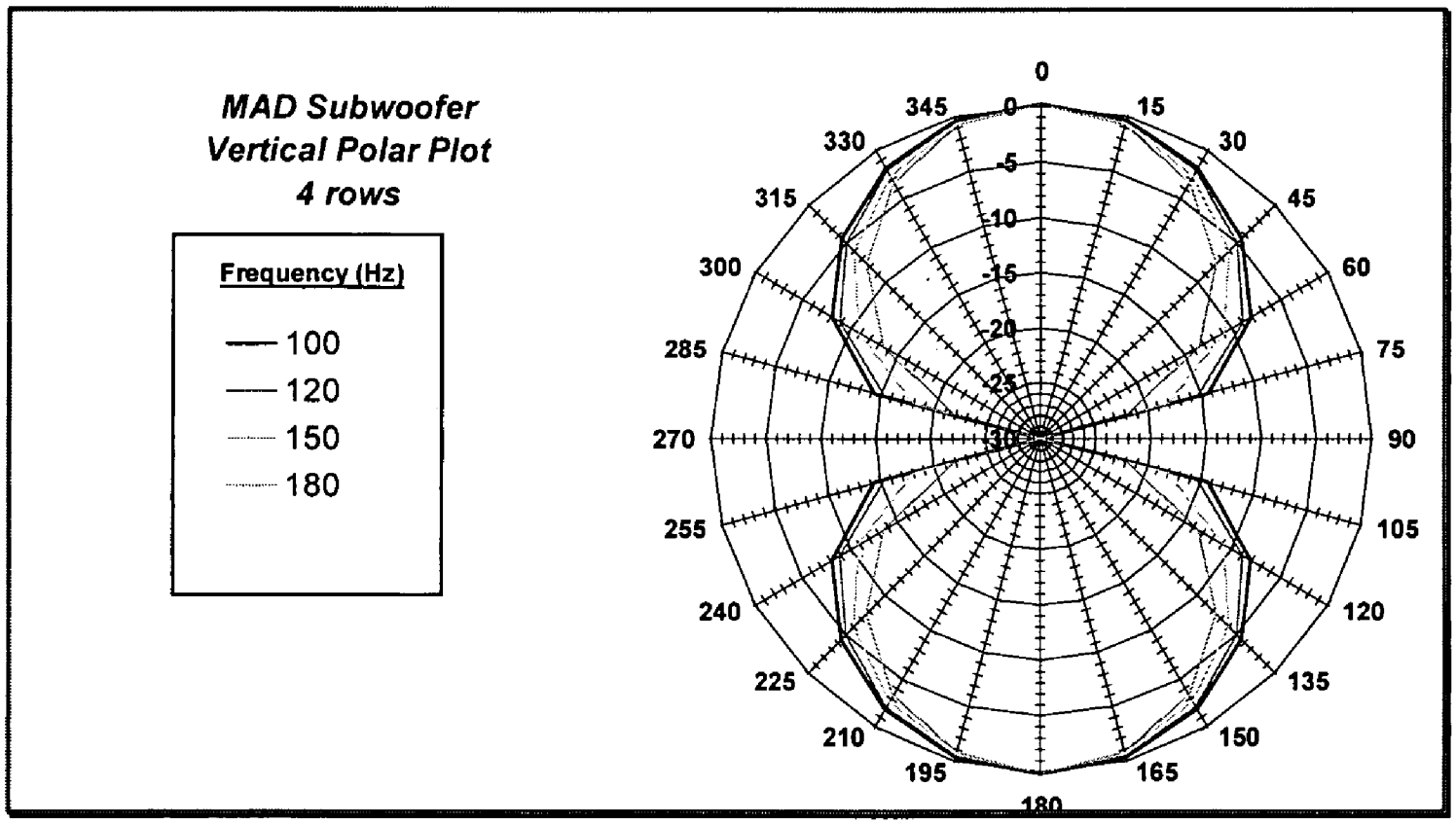
FIG. 6 shows simulated vertical polar plots.
Figure 7:
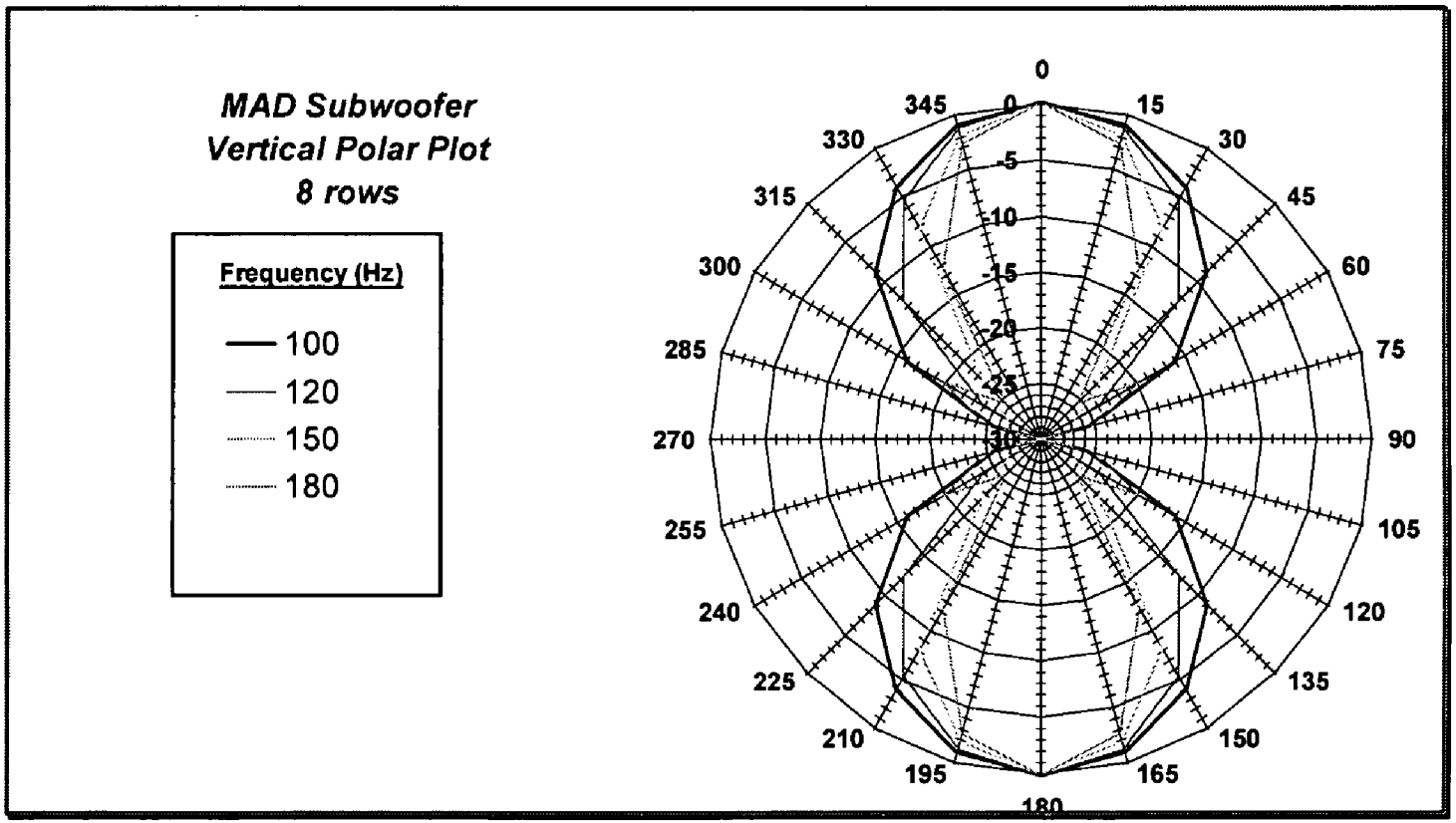
FIG. 7 shows simulated vertical polar plots.

The plots in FIGS. 5-7 show exemplary sound dispersion plots of low-frequency dipole surface arrays using Magnetic Audio Devices (MAD) subwoofers from HPV Technologies LLC of Costa Mesa, Calif. The dipole surface arrays shown in FIGS. 5-7 are flat arrays and not curved arrays. FIG. 5 shows simulated horizontal polar plots for a single row of dipole speakers at frequencies of 100 Hz, 120 Hz, 150 Hz, and 180 Hz. The sound dispersion patterns tend to become more directional as the frequency increases. FIG. 6 shows simulated vertical polar plots at frequencies of 100 Hz, 120 Hz, 150 Hz, and 180 Hz, in which 4 rows of subwoofers are used. FIG. 7 shows simulated vertical polar plots at frequencies of 100 Hz, 120 Hz, 150 Hz, and 180 Hz, in which 8 rows of subwoofers are used. FIGS. 5-7 show that the sound dispersion patterns tend to become more directional as the frequency increases, and the sound dispersion patterns also tend to become more directional as the number of rows increases and the size of the array becomes comparable to the size of the acoustic wavelength produced at a given frequency. In some implementations, the low-frequency dipole surface array may have additional rows in either the horizontal or vertical directions, or both the horizontal and vertical directions to increase sound directionality in those directions.

Figure 8:
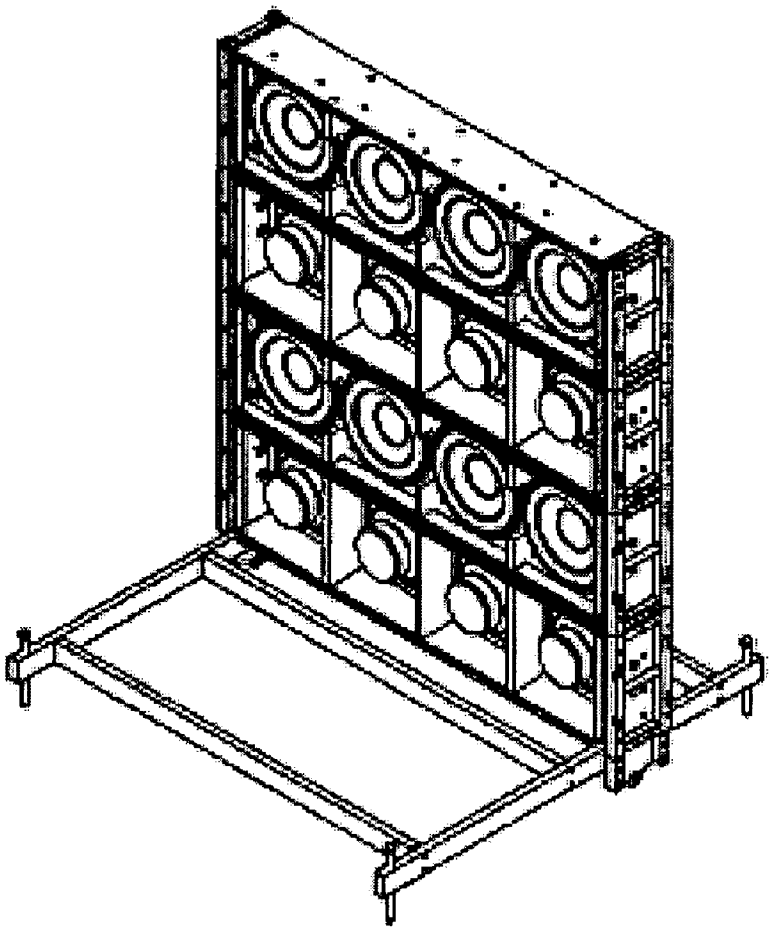
FIG. 8 shows a subwoofer array that is configured to use ground support.

FIG. 8 shows a dipole subwoofer array with ground support. The modular system of open frames are connected with a rigging system, which allows an array of drivers to be positioned on the ground or another flat, stable surface. In one example, four 12" very long-throw, low-distortion, fast subwoofers are mounted in each frame. Frames can be of very shallow construction.

Figure 10:
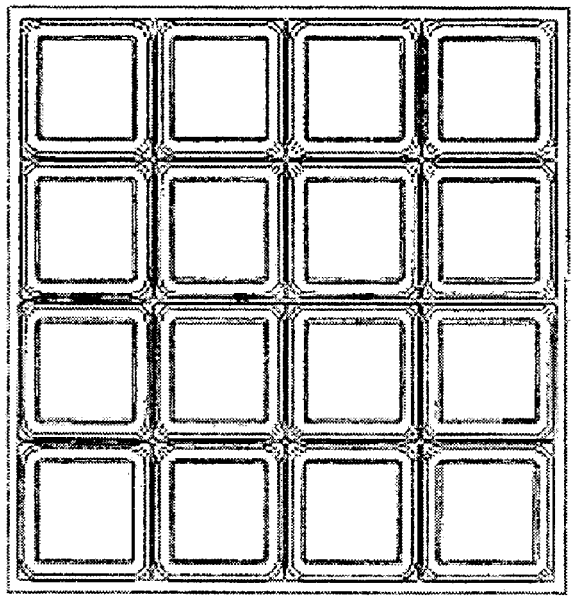
FIG. 10 shows a subwoofer array with rectangular subwoofers.
Figure 9:
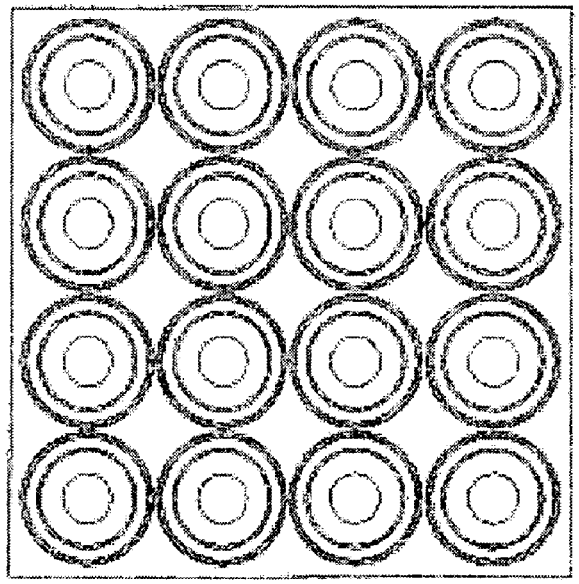
FIG. 9 shows a subwoofer array with circular subwoofers.

Other implementations of the subwoofer array can be constructed with subwoofers of different shapes. For example, FIG. 9 shows a dipole subwoofer array with circular-shaped subwoofers. FIG. 10 shows a dipole subwoofer array with rectangular-shaped subwoofers. By using rectangular-shaped woofers, the empty spaces between adjacent subwoofers can be minimized and the surface area of the array can be better filled with the subwoofers.

Figure 12:
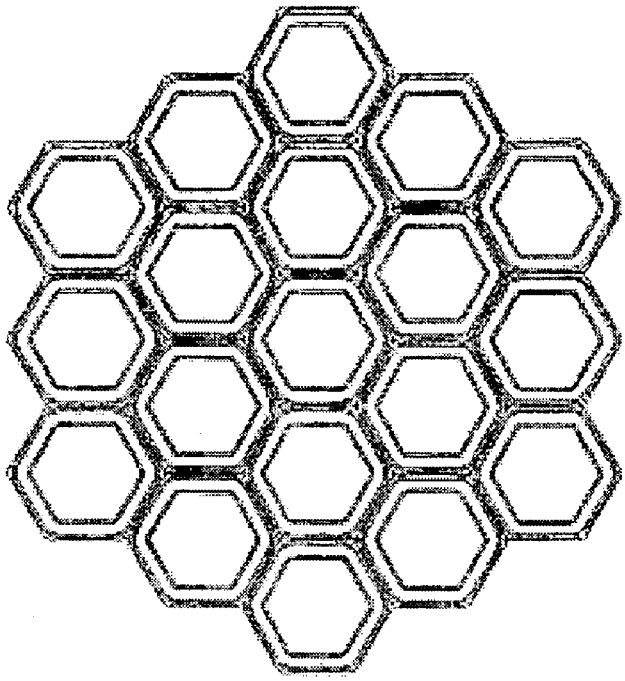
FIG. 12 shows a subwoofer array with 6-sided subwoofers.
Figure 11:
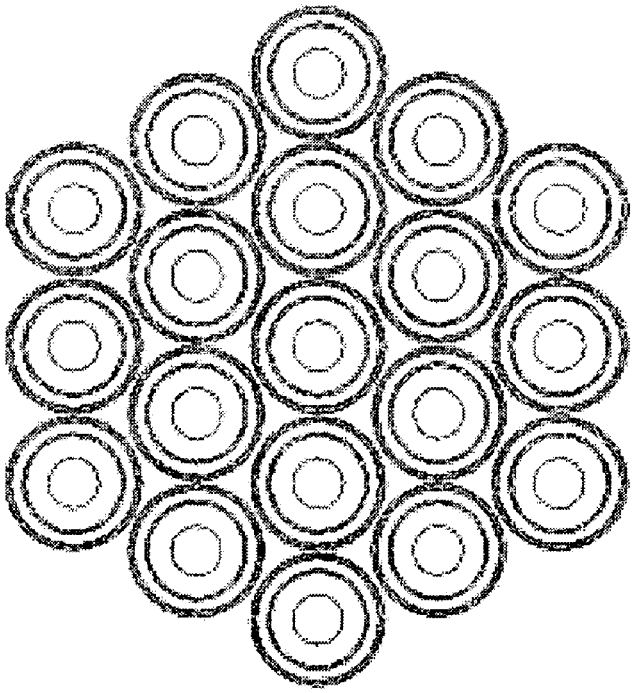
FIG. 11 shows another subwoofer array with circular subwoofers.

The dipole subwoofer arrays may have different numbers of subwoofers in each row. For example, FIG. 11 shows another subwoofer array with circular-shaped subwoofers, in which the rows are arranged in a hexagonal-like pattern. The array arrangement shown in FIG. 11 can be used to minimize the empty spaces between adjacent subwoofers for circular-shaped subwoofers. FIG. 12 shows a subwoofer array with 6-sided (hexagonal) subwoofers, in which the rows are arranged in a hexagonal pattern. The array arrangement shown in FIG. 12 can be used to minimize the empty spaces between adjacent subwoofers for 6-sided subwoofers.

Figure 13B:
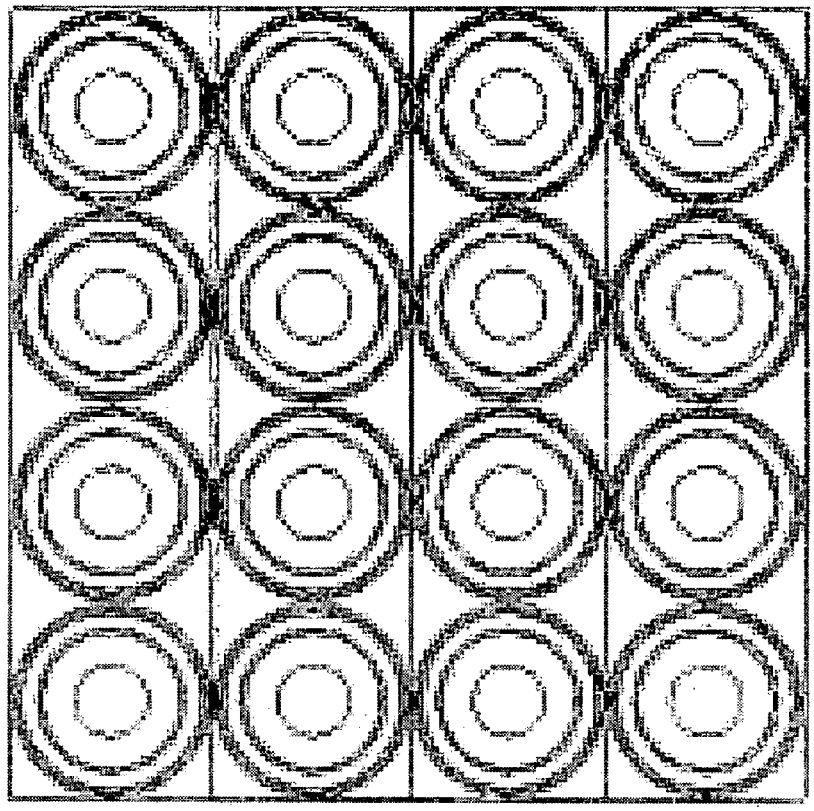
FIG. 13B shows a flat surface array of the subwoofer array of FIG. 13A.
Figure 13A:
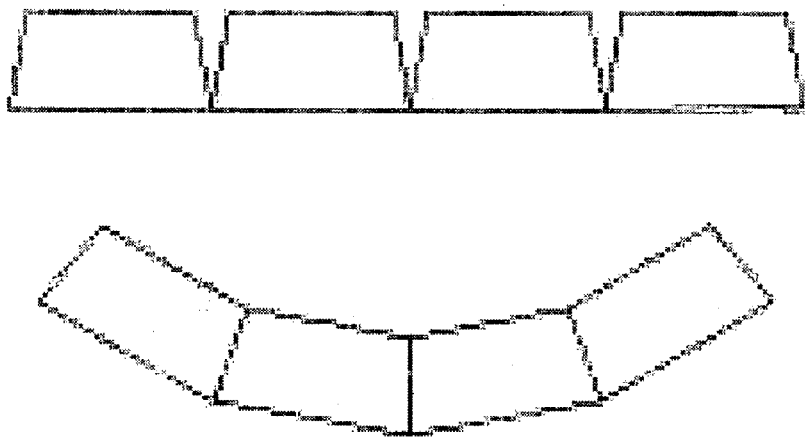
FIG. 13A shows a side view of a vertically curved surface array.
Figure 14B:
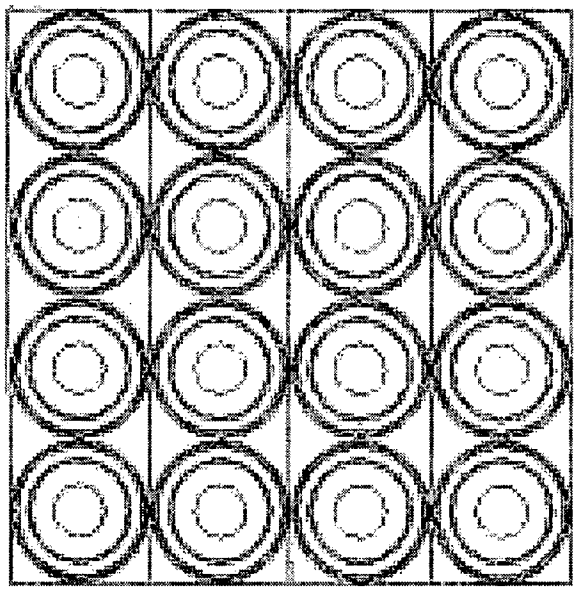
FIG. 14B shows a flat surface array of the subwoofer array of FIG. 14A.
Figure 14A:
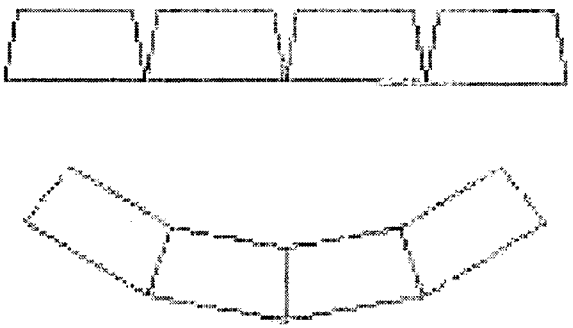
FIG. 14A shows a side view of a horizontally curved surface array.

The flat panel or cone low-frequency transducers can be mounted on a flat or curved surface to produce controlled low-frequency sound dispersion in both horizontal and vertical planes. Multiple low-frequency drivers can be arranged on a flat or curved surface to create adequate acoustical output and to provide a desired sound coverage without using heavy, bulky closed cabinets. For example, FIG. 13A shows side views of a vertically curved surface array. FIG. 13B shows a flat surface array of the subwoofer array of FIG. 13A. FIG. 14A shows side views of a horizontally curved surface array. FIG. 14B shows a flat surface array of the subwoofer array of FIG. 14A. FIG. 15A shows side views of a vertically curved surface array. FIG. 15B shows a flat surface array of the subwoofer array of FIG. 15A. FIG. 15C shows side views of a horizontally curved surface array of the flat surface array of FIG. 15B. The arrays of FIGS. 15A and 15C can be used produce controlled low-frequency sound dispersion in both the horizontal and vertical planes.

Other implementations may be within the scope of the following claims.

What is claimed is:

1. A dipole speaker system comprising:

an open frame rigging system;

a plurality of subwoofers mounted in a dipole configuration in the open frame rigging system to produce controlled sound dispersion in horizontal and vertical planes;

wherein the subwoofers are operable to produce low-frequency sound dispersion below about 300 Hz, wherein the subwoofers mounted in the dipole configuration comprise a first set of subwoofers facing a first direction and a second set of subwoofers facing a second direction, the second direction being substantially 180 degrees with respect to the first direction, and wherein the first and second sets of subwoofers are configured to concurrently move in a same direction when a signal is applied to the subwoofers.

2. The system in accordance with claim 1, wherein the dipole speaker system comprises a modular system of open frames.

3. The system in accordance with claim 1, wherein the dipole speaker system is configured to be a hanging system.

4. The system in accordance with claim 1, wherein the dipole speaker system is configured to be supported on a flat surface.

5. The system in accordance with claim 1, wherein approximately half of an amount of coils in each subwoofer are configured to travel a magnetic gap of the subwoofer, and approximately half of the amount of coils in each subwoofer are configured to travel outside the magnetic gap.

6. The system in accordance with claim 5, wherein the speaker system is configured to cancel non-linear distortion, and wherein the subwoofers are closely spaced in the rigging system to create a large baffle.

7. The system in accordance with claim 6, wherein at least two or more subwoofers are connected in the rigging system in a first row in the first direction, and wherein at least two or more subwoofers are connected in the rigging system in a second row in the second direction.

8. The system in accordance with claim 7, wherein the rigging system comprises multiple pairs of rows of subwoofers, wherein one row in a row pair is facing the first direction, and wherein a second row in the row pair is facing the second direction, and wherein the rigging system is configured to be adjustable so that adjacent row pairs face different angles.

9. The system in accordance with claim 8, wherein the dipole speaker system is adjustable such that the multiple pairs of rows of subwoofers form a curved surface when a size of the dipole speaker system is about a comparable size as an acoustic wavelength produced at a predetermined frequency.

10. The system in accordance with claim 1, wherein the subwoofers comprise drivers, and wherein the drivers of the second set of subwoofers are electrically wired out-of-phase to reduce non-linear distortion.

11. A loudspeaker surface array comprising:

one or more rows of dipole speakers, wherein each dipole speaker comprises:

a first speaker facing a first direction; and a second speaker facing a second direction, wherein the second direction is facing a direction that is 180 degrees from the first direction, wherein the second speaker is electrically wired out-of-phase with respect to the first speaker to reduce non-liner distortion, and wherein each of the first and second speakers is configured to concurrently move in a same direction when a signal is applied; and an open frame rigging system to mount each dipole speaker in the one or more rows.

12. The loudspeaker surface array in accordance with claim 11, wherein the open frame rigging system comprises flexible joints so that at least two or more rows of dipole speakers form a curved dipole surface array.

13. The loudspeaker surface array in accordance with claim 12, wherein the flexible joints are configured to enable two or more rows of dipole speakers to be splayed to effectively direct sound coverage across a range of angles.

14. The loudspeaker surface array in accordance with claim 11, wherein the rigging system is configured to enable the loudspeaker surface array to be suspended at a predetermined elevation above ground.

15. The loudspeaker surface array in accordance with claim 11, wherein the speakers comprise any of sound reinforcement subwoofers, flat panel transducers, cone transducers, and long-throw, low-distortion, fast woofers.

16. The loudspeaker surface array in accordance with claim 11, wherein the rigging system is configured to enable the loudspeaker surface array to direct sound at different angles along a curved surface when a size of the loudspeaker surface array is comparable to a size of a wavelength of a sound produced at a predetermined frequency.

17. The loudspeaker surface array in accordance with claim 16, wherein the size of the loudspeaker surface array is a fraction of the size of a wavelength of the sound produced or a multiple of the size of a wavelength of the sound produced.

18. A method to produce controlled low-frequency sound dispersion in both horizontal and vertical planes of a dipole loudspeaker surface array, the method comprising:

mounting a first row of subwoofers in a first direction in an open frame rigging system;

mounting a second row of subwoofers in a second direction in the open frame rigging system, the second direction being about 180 degrees with respect to the first direction; and wiring the subwoofers in the second row to be out-of-phase with respect to the subwoofers of the first row to reduce non-liner distortion, wherein the first and second rows of subwoofers are configured to concurrently move in a same direction when a signal is applied, and wherein each subwoofer is operable to produce low-frequency sound dispersion below about 300 Hertz.

19. The method in accordance with claim 18, wherein each row comprises closely-spaced subwoofers.

20. The method in accordance with claim 18, further comprising:

mounting a third row of subwoofers in the first direction in an open frame rigging system;

mounting a fourth row of subwoofers in the second direction in the open frame rigging system; and wiring the subwoofers in the fourth row to be out-of-phase with respect to the subwoofers in the third row to reduce non-liner distortion, wherein the third and fourth rows of subwoofers are configured to concurrently move in a same direction when a signal is applied.

21. The method in accordance with claim 18, further comprising adjusting the direction of the rows of the dipole loudspeaker surface array to change a horizontal and vertical acoustical radiation pattern.

22. The method in accordance with claim 18, further comprising adding additional rows of subwoofers in a dipole configuration to narrow a sound dispersion pattern for a frequency.

23. The method in accordance with claim 18, further comprising controlling a directionality of sound dispersion by adding additional rows of subwoofers in a dipole configuration, wherein a size of the dipole loudspeaker surface array is comparable to a size of a wavelength of a predetermined frequency produced by the array.

24. The method in accordance with claim 23, further comprising controlling the directionality of sound dispersion by adjusting a curvature of the dipole loudspeaker surface array when the size of the array is comparable to a size of the wavelength of the predetermined frequency produced by the array.

* * * * *